US010907113B2

(12) United States Patent
Sawaguchi et al.

(10) Patent No.: US 10,907,113 B2
(45) Date of Patent: Feb. 2, 2021

(54) LUBRICATING GREASE COMPOSITION, CLUTCH AND POWER WINDOW MOTOR

(71) Applicants: NOK KLUEBER CO., LTD., Tokyo (JP); DENSO CORPORATION, Aichi-pref (JP)

(72) Inventors: Wataru Sawaguchi, Kita Ibaraki (JP); Yuta Miyagawa, Kita Ibaraki (JP); Ryousuke Oguri, Kariya (JP)

(73) Assignees: NOK KLUEBER CO., LTD., Tokyo (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 16/266,214

(22) Filed: Feb. 4, 2019

(65) Prior Publication Data

US 2019/0241826 A1 Aug. 8, 2019

(30) Foreign Application Priority Data

Feb. 7, 2018 (JP) ..... 2018-019992

(51) Int. Cl.

| | |
|---|---|
| ***C10M 169/00*** | (2006.01) |
| ***C10M 169/02*** | (2006.01) |
| ***C10M 117/04*** | (2006.01) |
| ***C10M 169/04*** | (2006.01) |
| ***E05F 15/697*** | (2015.01) |
| ***C10M 103/06*** | (2006.01) |
| ***C10M 111/02*** | (2006.01) |
| ***C10M 117/00*** | (2006.01) |
| *C10N 20/06* | (2006.01) |
| *C10N 40/08* | (2006.01) |
| *C10N 50/10* | (2006.01) |
| *C10N 50/00* | (2006.01) |

(52) U.S. Cl.

CPC ..... *C10M 169/02* (2013.01); *C10M 103/06* (2013.01); *C10M 111/02* (2013.01); *C10M 117/00* (2013.01); *C10M 117/04* (2013.01); *C10M 169/00* (2013.01); *C10M 169/04* (2013.01); *E05F 15/697* (2015.01); *C10M 2201/0623* (2013.01); *C10M 2203/003* (2013.01); *C10M 2207/106* (2013.01); *C10N 2020/06* (2013.01); *C10N 2040/08* (2013.01); *C10N 2050/015* (2020.05); *C10N 2050/10* (2013.01); *E05Y 2201/71* (2013.01); *E05Y 2900/55* (2013.01)

(58) Field of Classification Search

CPC . C10M 169/02; C10M 117/00; C10M 111/02; C10M 103/06; C10M 2207/106; C10M 2203/003; C10M 2201/0623; C10M 2207/1206; C10M 2207/1256; C10M 2215/222; C10M 2213/0623; C10M 2201/1053; C10M 2201/1033; C10M 169/00; E05F 15/697; C10N 2220/082; C10N 2230/06; C10N 2220/022; C10N 2250/12; C10N 2250/10; C10N 2240/08; E05Y 2800/108; E05Y 2900/55; E05Y 2201/71

See application file for complete search history.

(56) References Cited

U.S. PATENT DOCUMENTS

| | | | | |
|---|---|---|---|---|
| 2005/0205989 | A1* | 9/2005 | Shibuya | C09K 5/14 257/712 |
| 2011/0082060 | A1 | 4/2011 | Faci et al. | |
| 2012/0061200 | A1 | 3/2012 | Yamashita et al. | |
| 2017/0002285 | A1* | 1/2017 | Hirooka | C10M 169/04 |

FOREIGN PATENT DOCUMENTS

| | | | |
|---|---|---|---|
| EP | 2 133 407 | A1 | 12/2009 |
| JP | 2012-082952 | A | 4/2012 |
| JP | 5450935 | B | 3/2014 |
| JP | 2015193858 | A * | 11/2015 |
| WO | WO-2015125805 | A1 * | 8/2015 |

OTHER PUBLICATIONS

German Office Action dated Jan. 22, 2020 for corresponding German Application No. 10 2019 201 458.5 and English translation.

* cited by examiner

*Primary Examiner* — Taiwo Oladapo
(74) *Attorney, Agent, or Firm* — Pearne & Gordon LLP

(57) ABSTRACT

A lubricating grease composition includes a base oil, a thickener, and a solid lubricant, wherein the base oil is a synthetic hydrocarbon oil with a kinematic viscosity of 600 to 2000 $mm^2/s$ at 40° C., the thickener is a barium complex soap, and the solid lubricant is an inorganic fine particle with Mohs hardness of 3 to 6 and an average particle size of 10 to 40 μm.

15 Claims, No Drawings

LUBRICATING GREASE COMPOSITION, CLUTCH AND POWER WINDOW MOTOR

CROSS REFERENCE TO RELATED APPLICATIONS

This application claims priority to Japanese Patent Application No. 2018-019992, filed on Feb. 7, 2018, which is hereby incorporated by reference in its entirety.

BACKGROUND

Technical Field

The present disclosure relates to a lubricating grease composition having a high coefficient of static friction and excellent durability, a clutch having the lubricating grease composition, and a power window motor including the clutch.

Background

Grease is conventionally used as a lubricant used for gears and sliding compartments. In recent years, in automobile parts, household electrical appliances, electronic information equipment, OA equipment, and the like, resin members are increasingly used for gears and sliding compartments for the purpose of weight saving and cost reduction. In recent years, in the reduction gear part, the clutch part, and the like in the speed reducer of automobiles or office automation equipment, the grease used for the sliding part between resin members or between a resin member and a metal member is required to have a high coefficient of static friction to prevent slipping at rest. Such grease is also required to have high durability (the coefficient of static friction does not change over time and the sliding part does not generate abnormal noise).

For example, Japanese Patent No. 5450935 discloses a lubricating grease composition used for a sliding part between resin members or between a resin member and a metal member and having a high coefficient of static friction.

In addition, Japanese Patent Application Laid-Open No. 2012-82952 discloses a clutch for preventing reverse rotation mounted on a motor as a drive source of a power window device. The clutch includes, inside the annular collar, a driving side rotor integrally rotating with a rotating shaft, a driven side rotor integrally rotating with a worm shaft, and a rolling element. The driven side rotor has a control surface opposed to the inner peripheral surface of the collar, and the rolling element is disposed between the control surface and the inner peripheral surface of the collar. In a motor including such a clutch, when the driving side rotor is rotated by the rotation driving of the rotating shaft, the rolling element, the driven side rotor, and the worm shaft rotate integrally, and the window glass of the vehicle is opened and closed based on the rotation of the worm shaft. On the other hand, in the non-rotation driving state of the rotating shaft (driving side rotor), the rolling element is clamped between the control surface of the driven side rotor and the inner peripheral surface of the collar to form a wedge so that the rotation of the driven side rotor is prevented (locked). Thus, opening and closing of the window glass of the vehicle can be suppressed, for example, by an external force other than the motor driving force.

Grease is applied to the inner peripheral surface of the collar. At the time of rotation of the driven side rotor in the non-rotational driving state of the rotating shaft (driving side rotor), penetration of grease between the collar and the rolling element improves the frictional force acting between the collar and the rolling element and releases the rolling element from being clamped between the control surface of the driven side rotor and the inner peripheral surface of the collar to prevent the rolling elements from turning with the driven side rotor.

In recent years, the properties required for a lubricating grease composition have become severe, and a demand for the lubricating grease composition having a further higher coefficient of static friction and excellent durability than conventional lubricating grease compositions has been required.

SUMMARY

The present disclosure is related to providing a lubricating grease composition having high coefficient of static friction and excellent durability in consideration of the above circumstance.

Each aspect of the present disclosure is as follows.

[1] A lubricating grease composition comprising a base oil, a thickener, and a solid lubricant, wherein the base oil is a synthetic hydrocarbon oil with a kinematic viscosity of 600 to 2000 $mm^2/s$ at 40° C., the thickener is a barium complex soap, and the solid lubricant is an inorganic fine particle with Mohs hardness of 3 to 6 and an average particle size of 10 to 40 μm.

[2] The lubricating grease composition according to the above [1], wherein an amount of the solid lubricant blended is 10 to 60% by weight based on a total weight of the lubricating grease composition.

[3] The lubricating grease composition according to the above [1], used in a sliding part between resin members or between a resin member and a metal member.

[4] The lubricating grease composition according to the above [3], wherein the sliding part is a sliding part of a clutch.

[5] A clutch having the lubricating grease composition according to the above [1].

[6] A power window motor comprising a clutch having the lubricating grease composition according to the above [1].

The lubricating grease composition of the present disclosure has high coefficient of static friction and excellent durability.

DETAILED DESCRIPTION

The lubricating grease composition according to the present disclosure comprises the base oil, the thickener, and the solid lubricant.

The base oil used in the present disclosure is not particularly limited as long as the base oil is a synthetic hydrocarbon oil, and examples of the synthesis hydrocarbon oil include poly α-olefin, ethylene-α-olefin co-oligomer, ethylene-α-olefin copolymer, polybutene, alkylbenzene, and alkylnaphthalene. Among these synthetic hydrocarbon oils, poly α-olefin is preferable. The base oil may be used singly or in admixture.

The kinematic viscosity of the base oil is 600 to 2000 $mm^2/s$ at 40° C. When the kinematic viscosity of the base oil at 40° C. is less than 600 $mm^2/s$, the durability of the lubricating grease composition decreases. On the other hand, when the kinematic viscosity of the base oil at 40° C. exceeds 2000 $mm^2/s$, the coefficient of static friction becomes low. The kinematic viscosity of the base oil at 40°

C. can be measured according to JIS K 2283. The kinematic viscosity of the base oil at 40° C. is preferable to be 800 to 1500 $mm^2/s$. The kinematic viscosity of the base oil at 40° C. within this range can provide a lubricating grease composition having a higher coefficient of static friction and better excellent durability.

The thickener used in the present disclosure is the barium complex soap. As a thickener, one type of barium complex soap may be used, or two or more types of barium complex soap may be used. Using the barium complex soap as a thickener, the lubricating grease composition having a high coefficient of static friction can be obtained. An example of the barium complex soap includes a salt of an aliphatic dicarboxylic acid and a carboxylic acid amide. Examples of the aliphatic dicarboxylic acid include sebacic acid and azelaic acid. The amount of the thickener blended is preferable to be 10 to 30% by weight based on the total weight of the lubricating grease composition. The amount of the thickener blended within this range can provide a lubricating grease composition having high coefficient of static friction.

The solid lubricant used in the present disclosure is an inorganic fine particle having a Mohs hardness of 3 to 6 and an average particle size of 10 to 40 μm. Mohs hardness is a measure of the hardness for minerals, ranging from 1 to 10, and the hardest mineral with a hardness of 10 is diamond. As a measurement method, a sample of a target is rubbed with a reference mineral to judge whether the sample is scratched or not and to determine the hardness. The average particle size of the inorganic fine particle is measured by a laser diffraction type particle size distribution measuring apparatus. When the Mohs hardness of the inorganic fine particle is less than 3, the coefficient of static friction of the lubricating grease composition decreases, whereas when the Mohs hardness exceeds 6, the durability of the lubricating grease composition deteriorates. As described above, the inorganic fine particle is useful as the fine particle having a Mohs hardness of 3 to 6 and an average particle size of 10 to 40 μm. When the average particle size of the inorganic fine particle is less than 10 μm, the coefficient of static friction of the lubricating grease composition decreases, whereas when the average particle size exceeds 40 μm, the durability of the lubricating grease composition deteriorates.

The average particle size of the inorganic fine particle is preferable to be 20 to 40 μm. The average particle size of the inorganic fine particle within this range can provide a lubricating grease composition having a higher coefficient of static friction. Examples of the inorganic fine particle include calcium carbonate, fluorite, and magnesium oxide.

The amount of the solid lubricant blended is preferable to be 10 to 60% by weight, and more preferable to be 30 to 50% by weight, based on the total weight of the lubricating grease composition. When the amount of the solid lubricant blended is 10% by weight or more based on the total weight of the lubricating grease composition, the coefficient of static friction of the lubricating grease composition increases, and when the solid lubricant is used in the sliding part between the resin members or between the resin member and the metal member, slippage at rest can be prevented effectively. In addition, when the amount of the solid lubricant blended is 60% by weight or less based on the total weight of the lubricating grease composition, the lubricating grease composition does not become hard and the deterioration of the low temperature torque characteristic can be prevented.

The lubricating grease composition according to the present disclosure is preferable to have a worked penetration of 240 to 320. When the worked penetration is 240 or more, the low temperature torque characteristic is excellent and it is easy to slide smoothly in a low-temperature environment. Further, when the worked penetration is 320 or less, the oil separation characteristic at high temperatures is improved. The worked penetration can be measured according to the measurement method prescribed in JIS K 2220 7.

The lubricating grease composition according to the present disclosure may contain additives within a range that does not affect the effect of the lubricating grease composition. For example, known antioxidants, extreme pressure agents, rust inhibitors, corrosion inhibitors, and viscosity index improvers can be appropriately selected and contained.

Examples of the antioxidants include phenol antioxidants such as 2,6-di-tert-butyl-4-methylphenol and 4,4'-methylenebis (2,6-di-tert-butylphenol), amine antioxidants such as alkyl diphenyl amine, triphenyl amine, phenyl-α-naphthylamine, phenothiazine, alkylated phenyl-α-naphthylamine, and alkylated phenothiazine, and further phosphoric acid antioxidants and sulfur-containing antioxidants.

Examples of the extreme pressure agents include phosphorus compounds such as phosphate esters, phosphite esters, and phosphoric ester amine salts, sulfur compounds such as sulfides and disulfides, sulfur-containing metal salts such as metal dialkyl dithiophosphates and metal salts of dialkyl dithiocarbamic acid, and chlorine compounds such as chlorinated paraffin and chlorinated diphenyl.

Examples of the rust inhibitors include fatty acids, fatty acid amines, metal sulfonates, alkylsulfonic acid metal salts, alkylsulfonic acid amine salt, oxidized paraffin, and polyoxyethylene alkyl ether.

Examples of the corrosion inhibitors include benzotriazole, benzimidazole, thiadiazole, and sodium sebacate.

Examples of the viscosity index improvers include polymethacrylate, ethylene-propylene copolymers, polyisobutylene, polyalkylstyrene, and styrene-isoprene copolymer hydride.

The lubricating grease composition according to the present disclosure includes the base oil, the thickener, and the solid lubricant, the base oil is a synthetic hydrocarbon oil with a kinematic viscosity of 600 to 2000 $mm^2/s$ at 40° C., the thickener is a barium complex soap, and the solid lubricant is an inorganic fine particle with a Mohs hardness of 3 to 6 and an average particle size of 10 to 40 μm. Thus, the lubricating grease composition of the present disclosure has a high coefficient of static friction and excellent durability. The lubricating grease composition of the present disclosure is particularly suitable for use in the sliding part between the resin members or between the resin member and the metal member. As this sliding part, the sliding part of the clutch is preferable. The equipment with the clutch is not particularly limited, and examples of the equipment with the clutch include the power window motor. Examples of the clutch mounted in the power window motor include a clutch for preventing reverse rotation to prevent motor reversal by external force by connecting a rotating shaft generating rotational driving force of the power window motor and a worm shaft of a speed reduction mechanism for decelerating rotational driving force transmitted from the rotating shaft.

Examples

Hereinafter, preferred embodiments of the present disclosure will be specifically described based on Examples and Comparative Examples, but the present disclosure is not limited to these Examples.

(1) Method for Preparing Lubricating Grease Composition

A lubricating grease composition (sample oil) was prepared so that each component below had the amount blended (% by weight) shown in Table 1 and Table 2. Types of each component are described as follows.

<Base oil>

Base oil A (synthetic hydrocarbon oil) with a kinematic viscosity of 600 $mm^2/s$ at 40° C.: Mixed base oil (DURASYN (trademark) 166:LUCANT (trademark) HC-2000=60% by weight:40% by weight) of product name "DURASYN (trademark) 166" (manufactured by Rice male oligomers' Japan, a kinematic viscosity of 30 $mm^2/s$ at 40° C.) and product name "LUCANT (trademark) HC-2000" (manufactured by Mitsui Chemicals, Inc., a kinematic viscosity of 37500 $mm^2/s$ at 40° C.)

Base oil B (synthetic hydrocarbon oil) with a kinematic viscosity of 1000 $mm^2/s$ at 40° C.: Mixed base oil (DURASYN (trademark) 166:LUCANT (trademark) HC-2000=55% by weight:45% by weight) of product name "DURASYN (trademark) 166" (manufactured by Rice male oligomers' Japan, a kinematic viscosity of 30 $mm^2/s$ at 40° C.) and product name "LUCANT (trademark) HC-2000" (manufactured by Mitsui Chemicals, Inc., a kinematic viscosity of 37500 $mm^2/s$ at 40° C.)

Base oil C (synthetic hydrocarbon oil) with a kinematic viscosity of 2000 $mm^2/s$ at 40° C.: mixed base oil (DURASYN (trademark) 166:LUCANT (trademark) HC-2000=45% by weight:55% by weight) of product name "DURASYN (trademark) 166" (manufactured by Rice male oligomers' Japan, a kinematic viscosity of 30 $mm^2/s$ at 40° C.) and product name "LUCANT (trademark) HC-2000" (manufactured by Mitsui Chemicals, Inc., a kinematic viscosity of 37500 $mm^2/s$ at 40° C.)

Base oil D (synthetic hydrocarbon oil): "DURASYN (trademark) 166" (manufactured by Rice male oligomers' Japan, a kinematic viscosity of 30 $mm^2/s$ at 40° C.)

Base oil E (synthetic hydrocarbon oil) with a kinematic viscosity of 3000 $mm^2/s$ at 40° C.: mixed base oil (DURASYN (trademark) 166:LUCANT (trademark) HC-2000=40% by weight:60% by weight) of product name "DURASYN (trademark) 166" (manufactured by Rice male oligomers' Japan, a kinematic viscosity of 30 $mm^2/s$ at 40° C.) and product name "LUCANT (trademark) HC-2000" (manufactured by Mitsui Chemicals, Inc., a kinematic viscosity of 37500 $mm^2/s$ at 40° C.)

<Thickener>

Thickener A: barium complex soap

Thickener B: lithium soap, product name "Li-OHST" (manufactured by Katsuta Kako Co., Ltd.)

<Solid Lubricant>

Solid lubricant A: calcium carbonate, product name "SFT-2000" (manufactured by Sankyo Seifun Co., Ltd., Mohs hardness of 3 to 4, average particle size of 30 μm)

Solid lubricant B: calcium carbonate, product name "A" (manufactured by Sankyo Seifun Co., Ltd., Mohs hardness of 3 to 4, average particle size of 10 μm)

Solid lubricant C: magnesium oxide, product name "Pyroxisma 3320" (manufactured by Kyowa Chemical Industry Co., Ltd., Mohs hardness of 4 to 6, average particle size of 20 μm)

Solid lubricant D: silica, product name "SP-4200" (manufactured by San-Ei Silica Co., Ltd., Mohs hardness of 7, average particle diameter of 22 μm)

Solid lubricant E: mica, product name "MK-300" (manufactured by Katakura Corp. Agri Co., Ltd., Mohs hardness of 2.8, average particle size of 15 μm)

Solid lubricant F: calcium carbonate, product name "#3500" (manufactured by Sankyo Seifun Co., Ltd., Mohs hardness of 3 to 4, average particle diameter of 1 μm)

Solid lubricant G: calcium carbonate, product name "G-120" (manufactured by Sankyo Seifun Co., Ltd., Mohs hardness of 3 to 4, average particle size of 50 μm)

Solid lubricant H: polytetrafluoroethylene (PTFE), product name "Dyneon TF 9207 Z" (manufactured by 3M Japan Ltd.)

Solid lubricant I: melamine cyanurate (MCA), product name "MC-6000" (manufactured by Nissan Chemical Industries, Ltd.)

<Antioxidant>

Phenylnaphthylamine: product name "VANLUBE (trademark) 81" (manufactured by Sanyo Chemical Industries, Ltd.)

<Rust Inhibitor>

Neutral calcium sulfonate: product name "NA-SUL (trademark) CA-1089" (manufactured by KING Industries, Inc.)

The lubricating grease composition including the thickener A was prepared as follows.

A base oil, sebacic acid, and carboxylic acid monostearyl amide were blended in a mixing and stirring vessel, and the mixture was heated and stirred at about 80 to 200° C. Thereafter, barium hydroxide was added to the mixture to perform a saponification reaction to prepare a barium complex soap. Blending was performed such that the amount of each component of the thickener was set to blending ratios of 27.5% by weight of sebacic acid, 41.5% by mass of carboxylic acid monostearylamide, and 31% by weight of barium hydroxide based on the total amount of the thickener. Thereafter, after the barium complex soap was cooled, various additives were added to the gelatinous substance thus produced and stirred, and the resultant was passed through a roll mill or a high pressure homogenizer to prepare a lubricating grease composition.

A lubricating grease composition including the thickener B was prepared as follows.

A base oil, 12-hydroxystearic acid, and lithium hydroxide were blended in a mixing and stirring vessel, and the mixture was stirred while heated at about 80 to 130° C. and was subjected to saponification reaction to prepare a lithium soap. Blending was performed such that the amount of each component of the thickener was set to blending ratios of 88% by weight of 12-hydroxystearic acid and 12% by mass of lithium hydroxide based on the total amount of the thickener. Thereafter, after the lithium soap was cooled, various additives were added to the gelatinous substance thus produced and stirred, and then passed through a roll mill or a high pressure homogenizer to prepare a lubricating grease composition.

TABLE 1

| | Example 1 | Example 2 | Example 3 | Example 4 | Example 5 | Example 6 |
|---|---|---|---|---|---|---|
| Base oil A | 33.5 | | | | | 30 |
| Base oil B | | 33.5 | | | 64.5 | |
| Base oil C | | | 33.5 | 64.5 | | |

TABLE 1-continued

| | Example 1 | Example 2 | Example 3 | Example 4 | Example 5 | Example 6 |
|---|---|---|---|---|---|---|
| Base oil D | | | | | | |
| Base oil E | | | | | | |
| Thickener A | 15 | 15 | 15 | 24 | 24 | 13.5 |
| Thickener B | | | | | | |
| Solid lubricant A | | | 50 | | 10 | |
| Solid lubricant B | | | | | | 55 |
| Solid lubricant C | 50 | 50 | | 10 | | |
| Solid lubricant D | | | | | | |
| Solid lubricant E | | | | | | |
| Solid lubricant F | | | | | | |
| Solid lubricant G | | | | | | |
| Solid lubricant H | | | | | | |
| Solid lubricant I | | | | | | |
| Antioxidant | 1 | 1 | 1 | 1 | 1 | 1 |
| Rust inhibitor | 0.5 | 0.5 | 0.5 | 0.5 | 0.5 | 0.5 |
| Total amount | 100 | 100 | 100 | 100 | 100 | 100 |
| Viscosity of base oil (40° C.) | 600 | 1000 | 2000 | 2000 | 1000 | 600 |

TABLE 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Base oil A | | | | | | 50.5 | 33.5 | | |
| Base oil B | | | 64.5 | 33.5 | 43.5 | | | 53.5 | |
| Base oil C | | | | | | | | | |
| Base oil D | 28.5 | | | | | | | | 79.5 |
| Base oil E | | 33.5 | | | | | | | |
| Thickener A | 20 | 15 | 24 | 15 | | 18 | 15 | 19 | |
| Thickener B | | | | | 5 | | | | 8 |
| Solid lubricant A | 50 | 50 | | | 50 | | | | |
| Solid lubricant B | | | | | | | | | |
| Solid lubricant C | | | | | | | | | |
| Solid lubricant D | | | 10 | | | | | | |
| Solid lubricant E | | | | 50 | | | | | |
| Solid lubricant F | | | | | | 30 | | | |
| Solid lubricant G | | | | | | | 50 | | |
| Solid lubricant H | | | | | | | | 10 | 1 |
| Solid lubricant I | | | | | | | | 16 | 10 |
| Antioxidant | 1 | 1 | 1 | 1 | 1 | 1 | 1 | 1 | 1 |
| Rust inhibitor | 0.5 | 0.5 | 0.5 | 0.5 | 0.5 | 0.5 | 0.5 | 0.5 | 0.5 |
| Total amount | 100 | 100 | 100 | 100 | 100 | 100 | 100 | 100 | 100 |
| Viscosity of base oil (40° C.) | 30 | 3000 | 1000 | 1000 | 1000 | 600 | 600 | 1000 | 30 |

(2) Evaluation Method (2-1) Coefficient of Static Friction

Using a reciprocating tester, sample oil was applied onto a lower test piece, and an upper test piece was pressed against the lower test piece from above to be subjected to reciprocation. The coefficient of static friction was measured from the frictional force generated between the upper test piece and the lower test piece during reciprocation. The test conditions are shown below.

Upper test piece: polyimide (PI) ball with a diameter of 10 mm

Lower test piece: chrome molybdenum steel (SCM) plate

Test load: 10 kgf

Amount of sample oil applied: 0.05 g

Sliding speed: 10 mm/sec

Test temperature: normal temperature

Sliding distance: 10 mm

Evaluation criteria: when the coefficient of static friction for the first sliding operation was larger than 0.15, it was evaluated as "good", and when the coefficient of static friction for the first sliding operation was 0.15 or less, it was evaluated as "bad".

(2-2) Durability

In the lubricating grease composition, the durability was judged to be excellent, (a) when the coefficient of static friction did not change over time and (b) when the sliding portion did not generate noise. More specifically, the test was performed under the same conditions as the above "(2-1) Coefficient of static friction", and when the coefficient of static friction at the 100th sliding was larger than 0.15, it was judged that the coefficient of static friction did not change over time as in the above (a), and when the coefficient of dynamic friction at the 100th sliding was less than 0.15, it was judged that the sliding part did not generate noise as in the above (b). When the coefficient of static friction was larger than 0.15 and the coefficient of dynamic friction was less than 0.15 at the 100th sliding, it was judged as "good". When the coefficient of static friction was 0.15 or less, when the coefficient of dynamic friction was 0.15 or more, or when the coefficient of static friction was 0.15 or less and the coefficient of dynamic friction was 0.15 or more at the 100th sliding, it was judged as "bad".

Evaluation results are shown in Tables 3 and 4 below.

TABLE 3

| | Example 1 | Example 2 | Example 3 | Example 4 | Example 5 | Example 6 |
|---|---|---|---|---|---|---|
| Coefficient of static friction at 1st sliding | 0.35 | 0.33 | 0.17 | 0.3 | 0.16 | 0.17 |
| Coefficient of dynamic friction at 1st sliding | 0.14 | 0.14 | 0.11 | 0.13 | 0.1 | 0.12 |
| Evaluation of coefficient of static friction | ○ | ○ | ○ | ○ | ○ | ○ |
| Coefficient of static friction at 100th sliding | 0.34 | 0.32 | 0.18 | 0.25 | 0.16 | 0.19 |
| Coefficient of dynamic friction at 100th sliding | 0.14 | 0.14 | 0.12 | 0.13 | 0.1 | 0.14 |
| Durability | ○ | ○ | ○ | ○ | ○ | ○ |

TABLE 4

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Coefficient of static friction at 1st sliding | 0.19 | 0.14 | 0.3 | 0.13 | 0.14 | 0.13 | 0.19 | 0.08 | 0.06 |
| Coefficient of dynamic friction at 1st sliding | 0.12 | 0.1 | 0.19 | 0.1 | 0.09 | 0.1 | 0.12 | 0.05 | 0.04 |
| Evaluation of coefficient of static friction | ○ | X | ○ | X | X | X | ○ | X | X |
| Coefficient of static friction at 100th sliding | 0.24 | 0.15 | 0.32 | 0.14 | 0.16 | 0.15 | 0.22 | 0.09 | 0.08 |
| Coefficient of dynamic friction at 100th sliding | 0.17 | 0.11 | 0.22 | 0.11 | 0.12 | 0.12 | 0.16 | 0.06 | 0.05 |
| Durability | X | X | X | X | ○ | X | X | X | X |

From Table 1, it was found that, in Examples 1 to 6, since the base oil was a synthetic hydrocarbon oil having a kinematic viscosity of 600 to 2000 $mm^2/s$ at 40° C., the thickener was a barium complex soap, and the solid lubricant was an inorganic fine particle having a Mohs hardness of 3 to 6 and an average particle size of 10 to 40 μm, these composition had high coefficients of static friction and excellent durability.

On the other hand, in Comparative Example 1, the kinematic viscosity of the base oil at 40° C. was less than 600 $mm^2/s$, resulting in the lubricating grease composition with inferior durability. In Comparative Example 2, the kinematic viscosity at 40° C. of the base oil exceeded 2000 $mm^2/s$, resulting in the lubricating grease composition with a low coefficient of static friction and poor durability. In Comparative Example 3, the Mohs hardness of the solid lubricant exceeded 6, resulting in the lubricating grease composition with inferior durability. In Comparative Example 4, the Mohs hardness of the solid lubricant was less than 3, resulting in the lubricating grease composition with a low coefficient of static friction and poor durability. In Comparative Example 5, the thickener was a lithium soap, resulting in a low coefficient of static friction. In Comparative Example 6, the average particle size of the solid lubricant was less than 10 μm, resulting in the lubricating grease composition with a low coefficient of static friction and inferior durability. In Comparative Example 7, the average particle size of the solid lubricant exceeded 40 μm, resulting in the lubricating grease composition with inferior durability. In Comparative Example 8, the solid lubricant was an organic substance, resulting in the lubricating grease composition with a low coefficient of static friction and poor durability. In Comparative Example 9, the kinematic viscosity at 40° C. of the base oil was less than 600 $mm^2/s$, the thickener was a lithium soap, and the solid lubricant was an organic substance, resulting in the lubricating grease composition with a low coefficient of static friction and poor durability.

As described above, the lubricating grease composition according to the present disclosure is a lubricating grease composition containing a base oil, a thickener, and a solid lubricant, wherein the base oil is a synthetic hydrocarbon oil with a kinematic viscosity of 600 to 2000 $mm^2/s$ at 40° C., the thickener is a barium complex soap, and the solid lubricant is an inorganic fine particle with a Mohs hardness of 3 to 6 and an average particle size of 10 to 40 μm, and thus has a high coefficient of static friction and excellent durability.

Particularly, the lubricating grease composition according to one embodiment is suitable for use in the sliding part between resin members or between a resin member and a metal member, and thus can be applied to equipment, parts, and the like in various industrial fields. Preferably, the sliding part between the resin members or between the resin member and the metal member may be a sliding part of the clutch. The equipment with the clutch is not particularly limited, and an example of the equipment with the clutch includes the power window motor. An example of the clutch mounted in the power window motor includes a clutch for preventing reverse rotation to prevent motor reversal by external force by connecting a rotating shaft generating rotational driving force of the power window motor and a worm shaft of a speed reduction mechanism for decelerating rotational driving force transmitted from the rotating shaft.

The lubricating grease composition according to one embodiment is widely applicable to, for example, parts for office equipment such as copying machines and printers, power transmission devices such as speed reducers, speed increasers, gears, chains, and motors, drive system parts, braking system parts such as ABS, steering system parts, drive system parts such as transmissions, automobile reinforcement parts such as power window motors, power seat motors, and sunroof motors, hinge parts for electronic information equipment, mobile phones, and the like, and various parts and relatively moving mechanical parts in the food/pharmaceutical industry, steel, construction, glass industry, cement industry, chemistry/rubber/resin industry such as film tenter, environment/power equipment, papermaking/printing industry, wood industry, and textile/apparel industry. The lubricating grease composition according to one embodiment is also applicable to bearings such as rolling bearings, thrust bearings, dynamic pressure bearings, resin bearings, and linear motion devices.

What is claimed is:

1. A lubricating grease composition comprising 30 to 65% by weight of a base oil based on a total weight of the lubricating grease composition, 15 to 30% by weight of a thickener based on a total weight of the lubricating grease composition, and 10 to 60% by weight of a solid lubricant based on a total weight of the lubricating grease composition, wherein the base oil is a synthetic hydrocarbon oil with a kinematic viscosity of 600 to 2000 $mm^2/s$ at 40° C., the thickener is a barium complex soap, and the solid lubricant is an inorganic fine particle with Mohs hardness of 3 to 6 and an average particle size of 20 to 40 μm.

2. The lubricating grease composition according to claim 1, wherein an amount of the solid lubricant blended is 30 to 60% by weight based on a total weight of the lubricating grease composition.

3. The lubricating grease composition according to claim 1, used in a sliding part between resin members or between a resin member and a metal member.

4. The lubricating grease composition according to claim 3, wherein the sliding part is a sliding part of a clutch.

5. A clutch having the lubricating grease composition according to claim 1.

6. A power window motor comprising a clutch having the lubricating grease composition according to claim 1.

7. A lubricating grease composition comprising 30 to 65% by weight of a base oil based on a total weight of the lubricating grease composition, 15 to 30% by weight of a thickener based on a total weight of the lubricating grease composition, and 30 to 60% by weight of a solid lubricant based on a total weight of the lubricating grease composition, wherein the base oil is a synthetic hydrocarbon oil with a kinematic viscosity of 600 to 2000 $mm^2/s$ at 40° C., the thickener is a barium complex soap, and the solid lubricant is an inorganic fine particle with Mohs hardness of 3 to 6.

8. The lubricating grease composition according to claim 7, wherein the solid lubricant has an average particle size of 20 to 40 μm.

9. The lubricating grease composition according to claim 7, used in a sliding part between resin members or between a resin member and a metal member.

10. The lubricating grease composition according to claim 9, wherein the sliding part is a sliding part of a clutch.

11. The lubricating grease composition according to claim 7, wherein the amount of the solid lubricant is 30 to 50% by weight based on a total weight of the lubricating grease composition.

12. A clutch having the lubricating grease composition according to claim 7.

13. A power window motor comprising a clutch having the lubricating grease composition according to claim 7.

14. The lubricating grease composition according to claim 1, wherein the lubricating grease exhibits a coefficient of static friction for a first sliding operation of greater than 0.15 and a coefficient of dynamic sliding friction for a 100th sliding operation of less than 0.15, wherein in the test conditions are an upper test piece is a 10 mm diameter polyimide ball, a lower test piece of a chrome molybdenum steel plate, a test load force of 10 kg, 0.05 g of the lubricating grease, a sliding speed of 10 mm/sec, a sliding distance of 10 mm and 25° C. operating temperature.

15. The lubricating grease composition according to claim 7, wherein the lubricating grease exhibits a coefficient of static friction for a first sliding operation of greater than 0.15 and a coefficient of dynamic sliding friction for a 100th sliding operation of less than 0.15, wherein in the test conditions are an upper test piece is a 10 mm diameter polyimide ball, a lower test piece of a chrome molybdenum steel plate, a test load force of 10 kg, 0.05 g of the lubricating grease, a sliding speed of 10 mm/sec, a sliding distance of 10 mm and 25° C. operating temperature.

* * * * *